US011066858B1

(12) United States Patent
Motahari Asl

(10) Patent No.: US 11,066,858 B1
(45) Date of Patent: Jul. 20, 2021

(54) LATCH LOCKING MECHANISM

(71) Applicant: Soroush Motahari Asl, Hayward, CA (US)

(72) Inventor: Soroush Motahari Asl, Hayward, CA (US)

(73) Assignee: AI Incorporated, Toronto (CA)

( * ) Notice: Subject to any disclaimer, the term of this patent is extended or adjusted under 35 U.S.C. 154(b) by 375 days.

(21) Appl. No.: 16/241,308

(22) Filed: Jan. 7, 2019

Related U.S. Application Data

(60) Provisional application No. 62/614,719, filed on Jan. 8, 2018.

(51) Int. Cl.

| | |
|---|---|
| ***E05B 85/24*** | (2014.01) |
| ***E05B 65/00*** | (2006.01) |
| ***E05B 63/22*** | (2006.01) |
| *E05B 17/22* | (2006.01) |

(52) U.S. Cl.
CPC ..... *E05B 85/24* (2013.01); *E05B 63/22* (2013.01); *E05B 65/006* (2013.01); *E05B 17/22* (2013.01)

(58) Field of Classification Search
CPC ..... E05B 85/24; E05B 65/006; E05B 63/22; E05B 17/22; E05B 19/04
USPC ..... 70/162, 386; 292/146, 147, 150, 175, 292/179, 189, 239, 252; 220/315, 318, 220/908
See application file for complete search history.

(56) References Cited

U.S. PATENT DOCUMENTS

| | | | | |
|---|---|---|---|---|
| 3,586,360 | A | 6/1971 | Perrotta | |
| 3,593,547 | A | 7/1971 | Taylor | |
| 3,933,380 | A * | 1/1976 | Wellekens | E05B 55/12 292/175 |
| 4,370,874 | A | 2/1983 | Munn | |
| 4,865,368 | A * | 9/1989 | McCall | E05B 65/5292 292/175 |
| 4,915,430 | A | 4/1990 | Vitale | |
| 5,145,221 | A * | 9/1992 | Pennebaker | E05B 17/2034 292/146 |
| 5,465,191 | A | 11/1995 | Nomura et al. | |
| 5,478,126 | A | 12/1995 | Laesch | |
| 5,518,282 | A * | 5/1996 | Sawada | E05B 17/2011 292/252 |
| 6,077,107 | A | 6/2000 | Hetherington | |
| 6,196,034 | B1 | 3/2001 | Diebold et al. | |
| 6,481,829 | B1 | 11/2002 | Bailey et al. | |
| 6,679,533 | B1 | 1/2004 | Bruner et al. | |
| 7,044,509 | B2 * | 5/2006 | Radel | E05B 63/128 292/106 |
| 7,441,427 | B2 | 10/2008 | Vickers | |
| 8,408,607 | B2 * | 4/2013 | Michael | B65F 1/1615 292/95 |
| 2011/0025075 | A1 * | 2/2011 | Chang | E05C 1/10 292/175 |

* cited by examiner

*Primary Examiner* — Lloyd A Gall

(57) ABSTRACT

Provided is a latch mechanism including: a main body including a first enclosure and a second enclosure; a latch including: a latch body positioned within and slidingly coupled with the first enclosure of the main body; a latch lock fixed to the latch body; and a handle fixed to the latch body; and a latch locking mechanism including: a stopper positioned within and slidingly coupled with the second enclosure of the main body; a limit bar fixed to the latch body; a spring holder fixed to the latch body; and a spring positioned on the spring holder.

20 Claims, 8 Drawing Sheets

LATCH LOCKING MECHANISM

CROSS-REFERENCE TO RELATED APPLICATIONS

This application claims the benefit of Provisional Patent Application No. 62/614,719 filed Jan. 8, 2018, which is hereby incorporated by reference.

FIELD OF THE DISCLOSURE

This disclosure relates to locking mechanisms. More particularly, this disclosure relates to latch locking mechanisms.

BACKGROUND

Latches are used in a variety of applications. Latches include latch locking mechanisms that lock a particular part of a device in place by maintaining a closed position of the latch. An external force can be applied to the latch locking mechanism to alter the position of the latch to an open position such that the particular part of the device can be released. The design of latches can be challenging as there is often a common trade-off between ease of use and likelihood of accidentally moving the latch from a closed position to an open position. The challenge in latch design is further magnified when the device containing the latch moves during operation and the latch is exposed to a moving surface.

SUMMARY

The following presents a simplified summary of some embodiments of the techniques described herein in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Some aspects provide a latch mechanism including: a main body including a first enclosure and a second enclosure, wherein the first enclosure and second enclosure are separated by a separating wall including a slot along the length of the separating wall; a latch including: a latch body positioned within and slidingly coupled with the first enclosure of the main body; a latch lock fixed to the latch body and positioned within the first enclosure of the main body when the latch is in an open position and at least partially external to the main body through a first opening of the main body when the latch is in a closed position; and a handle fixed to the latch body and at least partially external to the main body through a second opening of the main body; and a latch locking mechanism including: a stopper positioned within and slidingly coupled with the second enclosure of the main body; a limit bar fixed to a face of the latch body facing towards the separating wall and capable of fitting through the slot in the separating wall; a spring holder fixed to the face of the latch body facing towards the separating wall and incapable of fitting through the slot in the separating wall; and a spring positioned on the spring holder and contacting the face of the latch body facing towards the separating wall on a first end of the spring and contacting the separating wall on a second end of the spring, wherein the spring is incapable of fitting through the slot in the separating wall.

BRIEF DESCRIPTIONS OF THE FIGURES

DETAILED DESCRIPTION OF SOME EMBODIMENTS

Figure 1:
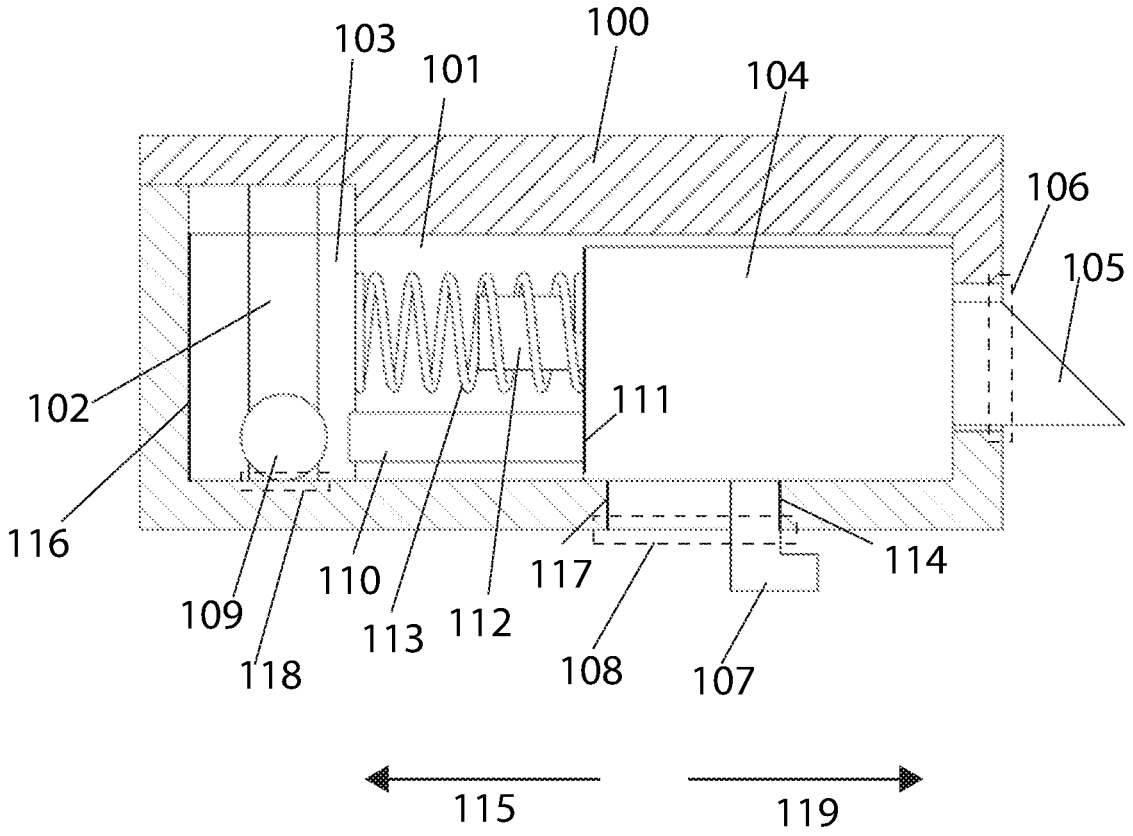
FIG. 1 illustrates a latch mechanism with a latch in a closed position according to some embodiments.

The present inventions will now be described in detail with reference to a few embodiments thereof as illustrated in the accompanying drawings. In the following description, numerous specific details are set forth in order to provide a thorough understanding of the present inventions. It will be apparent, however, to one skilled in the art, that the present invention may be practiced without some or all of these specific details. In other instances, well known process steps and/or structures have not been described in detail in order to not unnecessarily obscure the present invention. Further, it should be emphasized that several inventive techniques are described, and embodiments are not limited to systems implanting all of those techniques, as various cost and engineering trade-offs may warrant systems that only afford a subset of the benefits described herein or that will be apparent to one of ordinary skill in the art.

Some embodiments provide a latch mechanism including: a main body including a first enclosure and a second enclosure, wherein the first enclosure and second enclosure are separated by a separating wall including a slot along the length of the separating wall; a latch including: a latch body positioned within and slidingly coupled with the first enclosure of the main body; a latch lock fixed to the latch body and positioned within the first enclosure of the main body when the latch is in an open position and at least partially external to the main body through a first opening of the main body when the latch is in a closed position; and a handle fixed to the latch body and at least partially external to the main body through a second opening of the main body; and a latch locking mechanism including: a stopper positioned within and slidingly coupled with the second enclosure of the main body; a limit bar fixed to a face of the latch body facing towards the separating wall and capable of fitting through the slot in the separating wall; a spring holder fixed to the face of the latch body facing towards the separating wall and incapable of fitting through the slot in the separating wall; and a spring positioned on the spring holder and contacting the face of the latch body facing towards the separating wall on a first end of the spring and contacting the separating wall on a second end of the spring, wherein the spring is incapable of fitting through the slot in the separating wall.

In some embodiments, the latch is in the closed position when the handle contacts a first internal face of the second opening of the main body. In some embodiments, the latch slides in a first direction towards the separating wall and is in the open position when the latch lock is within the main body. In some embodiments, the latch is in the open position when the limit bar contacts an internal face of the second enclosure of the main body. In some embodiments, the latch is in the open position when the handle contacts a second internal face of the second opening of the main body.

In some embodiments, the stopper is positioned at a first end of the second enclosure of the main body and in line with the limit bar when the latch is in the closed position. In some embodiments, the limit bar contacts the stopper when the latch translates a minimal distance in the first direction to prevent the latch from sliding into the open position. In some embodiments, the minimal distance is between 10 to 20 percent of a total distance the latch slides from the closed position to a position where the latch lock is within the main body. In other embodiments, the minimal distance is less than the total distance the latch slides from the closed position to a position where the latch lock is within the main body.

In some embodiments, the stopper is positioned at a second end of the second enclosure of the main body when the latch is in the open position. In some embodiments, the stopper slides from the first end of the second enclosure of the main body to the second end of the second enclosure of the main body when the orientation of the latch mechanism changes. In some embodiments, a force of gravity acts on the stopper causing it to slide from the first end of the second enclosure of the main body to the second end of the second enclosure of the main body. In some embodiments, the latch mechanism is fixed to an item or a component of the item to lock the component in place. For example, the latch mechanism is fixed to a hinged door component position on a bottom face of an item. The hinged door is opened to replace batteries of the item. The latch mechanism is fixed in an orientation such that the stopper is positioned at the first end of the second enclosure of the main body when the item is oriented at least partially upright and at the second end of the second enclosure of the main body when the item is oriented at least partially upside down such that the latch can be placed in an open position to access the batteries.

In some embodiments, the spring is compressed when the latch is in the closed position and applies a force in a second direction opposite the first direction to maintain the latch in the closed position. In some embodiments, an external force acting in the first direction and applied to the handle of the latch causes the latch to slide in the first direction. In some embodiments, the external force is applied by a user or by a machine. In some embodiments, the spring slides the latch to the closed position from the open position when the external force acting in the first direction and applied to the handle is removed.

In some embodiments, the central axes of the first enclosure of the main body and the second enclosure of the main body are perpendicular to one another.

FIG. 1 illustrates a cross-sectional side view of an example of a latch mechanism including main body 100 including first enclosure 101 and second enclosure 102 separated by separating wall 103 including a slot (not shown in this figures) along the length of separating wall 103. The latch mechanism further includes a latch including latch body 104 positioned within and slidingly coupled with first enclosure 101 of the main body 100, latch lock 105 fixed to latch body 104 and positioned within first enclosure 101 of main body 100 when the latch is in an open position (not shown in this figure) and at least partially external to main body 100 through first opening 106 of main body 100 when the latch is in a closed position (shown in this figure), and handle 107 fixed to latch body 104 and at least partially external to main body 100 through second opening 108 of the main body 100. The latch mechanism further includes a latch locking mechanism including stopper 109 positioned within and slidingly coupled with second enclosure 102 of main body 100, limit bar 110 fixed to face 111 (bolded in the figure for visualization) of latch body 104 facing towards separating wall 103 and capable of fitting through the slot in separating wall 103, spring holder 112 fixed to face 111 of latch body 104 facing towards separating wall 103 and incapable of fitting through the slot in separating wall 103, and spring 113 positioned on spring holder 112 and contacting face 111 of latch body 104 facing towards separating wall 103 on a first end of spring 113 and contacting separating wall 103 on a second end of spring 113, wherein spring 113 is incapable of fitting through the slot in separating wall 103.

In FIG. 1, the latch is in the closed position as handle 107 is in contact with first internal face 114 (bolded in the figure for visualization) of second opening 108 of main body 100. The latch slides in first direction 115 towards separating wall 103 and is in the open position when latch lock 105 is within main body 100. In other instances, the latch is in the open position when limit bar 110 contacts internal face 116 (bolded in the figure for visualization) of second enclosure 102 of main body 100 or when handle 107 contacts second internal face 117 (bolded in the figure for visualization) of second opening 108 of main body 100.

In FIG. 1 the latch is in the closed position, therefore stopper 109 is positioned at first end 118 of second enclosure 102 of main body 100 and in line with limit bar 110. Limit bar 110 contacts stopper 109 when the latch translates a minimal distance in first direction 115 to prevent the latch from sliding into the open position. In the closed position, spring 113 is compressed and applies a force in second direction 119 opposite first direction 115 to maintain the latch in the closed position.

Figure 2:
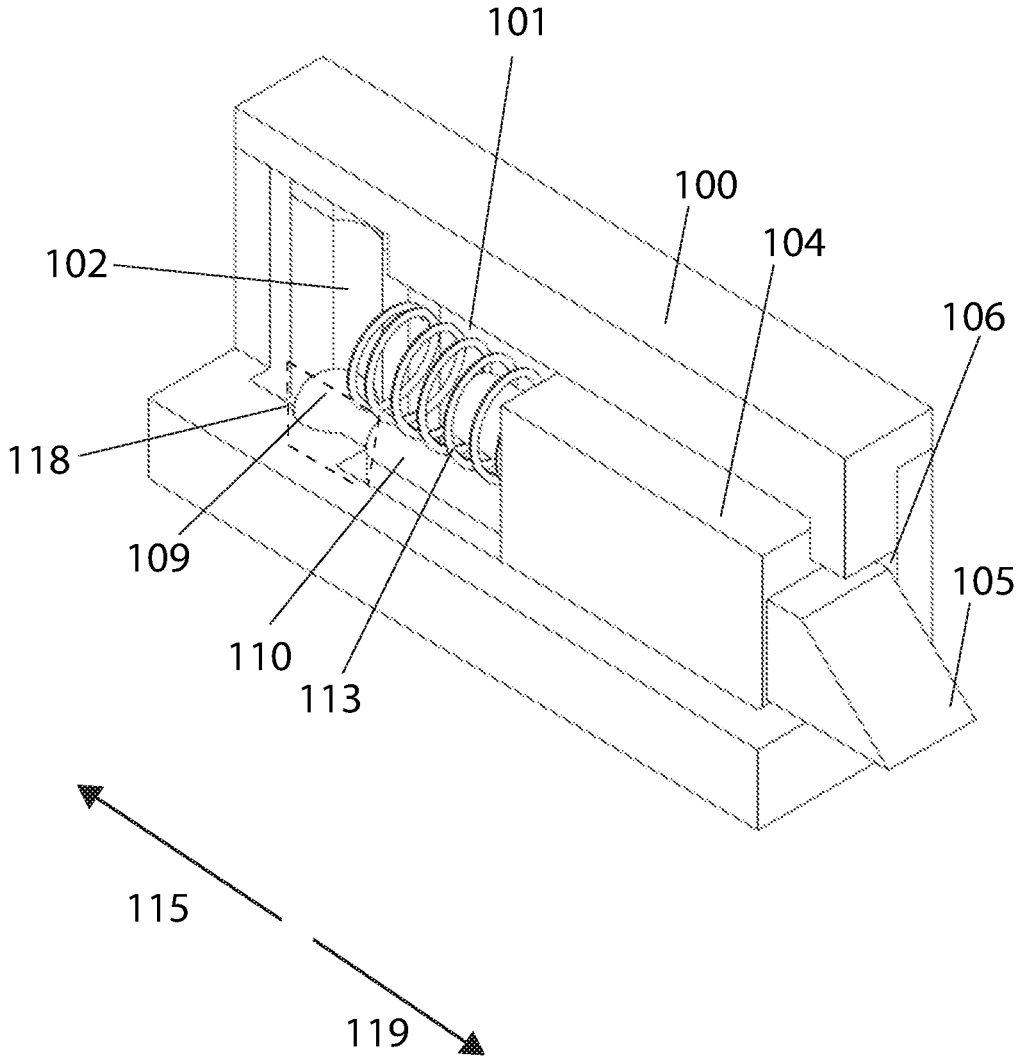
FIG. 2 illustrates a latch mechanism with a latch in a closed position according to some embodiments.

FIG. 2 illustrates a perspective cross-sectional view of the latch mechanism with the latch in the closed position. Latch body 104 is positioned within and slidingly coupled with first enclosure 101 of the main body 100. Latch lock 105 fixed to latch body 104 is partially external to main body 100 through first opening 106 of main body 100. Stopper 109 is slidingly coupled with second enclosure 102 of main body 100 and positioned at first end 118 of second enclosure 102 of main body 100 in line with limit bar 110. Spring 113 is compressed and applies a force in second direction 119 opposite first direction 115 to maintain the latch in the closed position.

Figure 3:
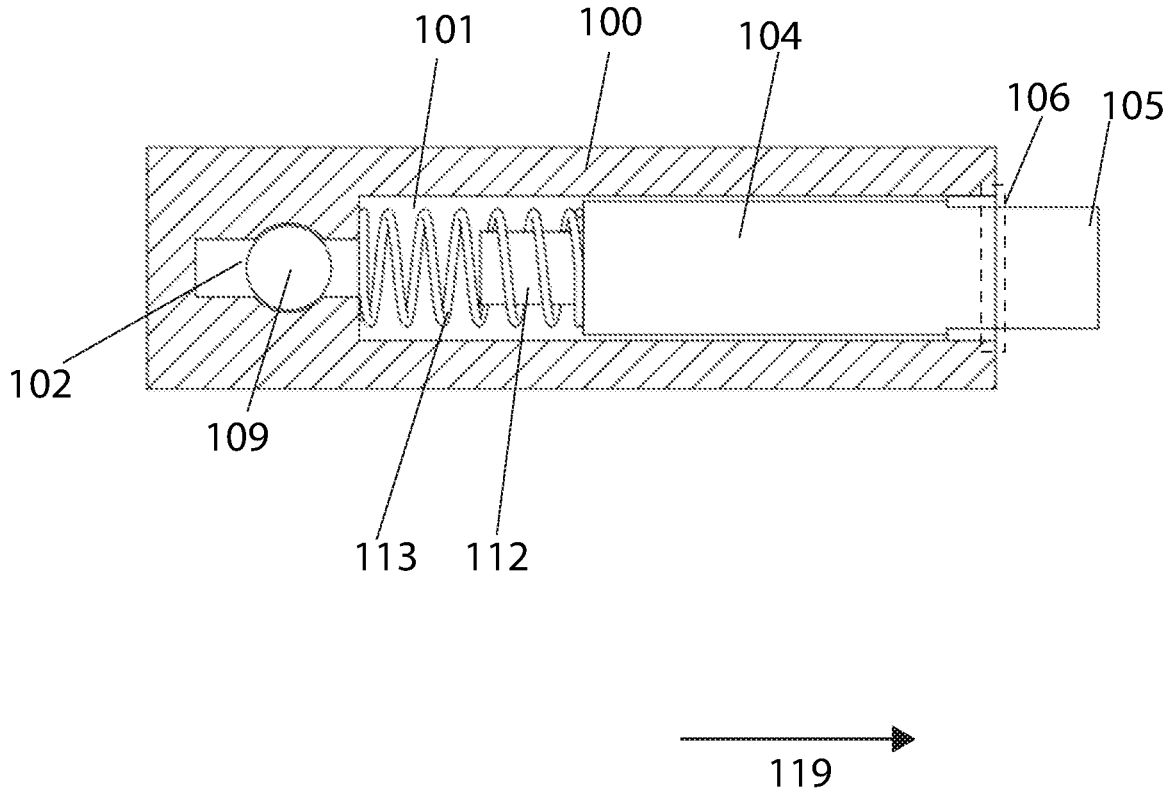
FIG. 3 illustrates a latch mechanism with a latch in a closed position according to some embodiments.

FIG. 3 illustrates a cross-sectional top view of the latch in the closed position. Latch body 104 is positioned within and slidingly coupled with first enclosure 101 of the main body 100. Latch lock 105 fixed to latch body 104 is partially external to main body 100 through first opening 106 of main body 100. Stopper 109 is slidingly coupled with second enclosure 102 of main body 100. Spring 113 positioned on spring holder 112 is compressed and applies a force in second direction 119 to maintain the latch in the closed position.

Figure 4:
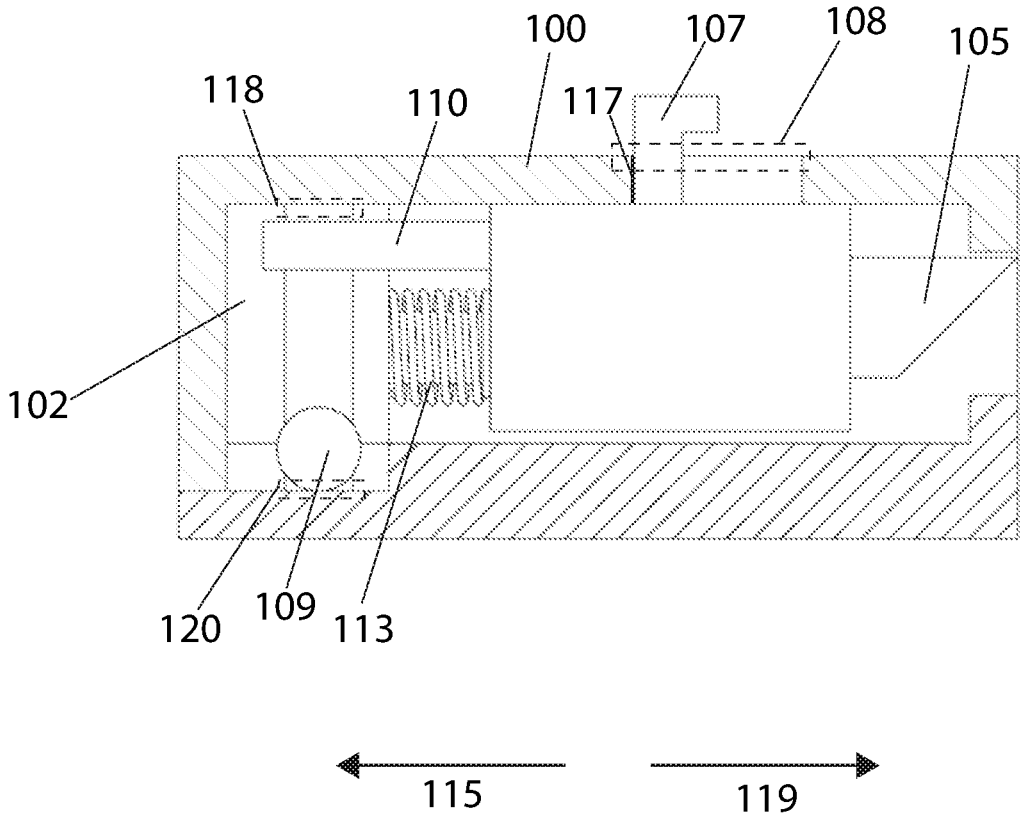
FIG. 4 illustrates a latch mechanism with a latch in an open position according to some embodiments.

FIG. 4 illustrates a cross-sectional side view of the latch in the open position. Stopper 109 is positioned at second end 120 of second enclosure 102 of main body 100. Stopper 109 slides from first end 118 of second enclosure 102 of main body 100 to second end 120 of second enclosure 102 of main body 100 when the orientation of the latch mechanism changes. A force of gravity acts on stopper 109 causing it to slide from first end 118 of second enclosure 102 of main body 100 to second end 120 of second enclosure 102 of main body 100. An external force acting in first direction 115 and applied to handle 107 of the latch causes the latch to slide in first direction 115 and spring 113 to be further compressed. The latch is in the open position when latch lock 105 is within main body 100 or when handle 107 contacts second internal face 117 (bolded in the figure for visualization) of second opening 108 of main body 100. In this case, the latch is not impeded from sliding into the open position by stopper 109 as it is no longer in line with limit bar 110. When the external force acting in first direction 115 and applied to handle 107 is removed, spring 113 slides the latch back to the closed position in second direction 119 from the open position as it decompresses.

Figure 5:
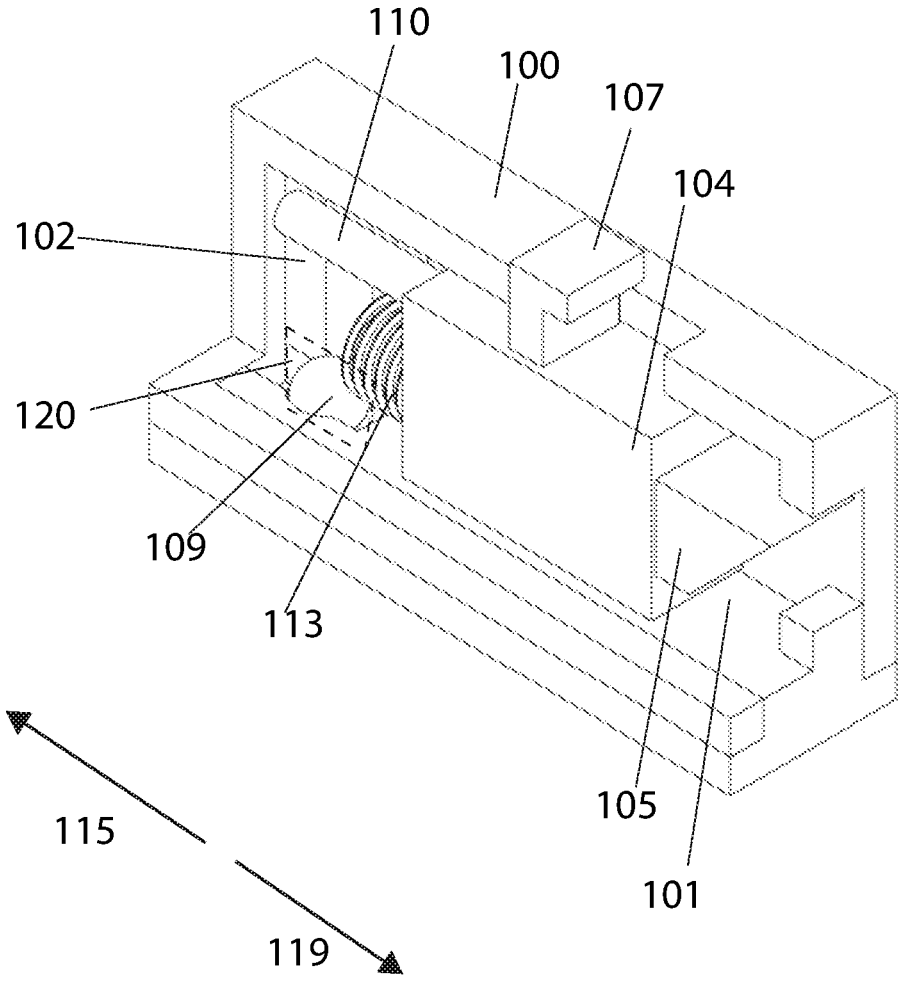
FIG. 5 illustrates a latch mechanism with a latch in an open position according to some embodiments.

FIG. 5 illustrates a perspective cross-sectional view of the latch mechanism with the latch in the open position. Latch body 104 is positioned within and slidingly coupled with first enclosure 101 of the main body 100. Latch lock 105 fixed to latch body 104 is within main body 100. Stopper 109 is slidingly coupled with second enclosure 102 of main body 100 and positioned at second end 120 of second enclosure 102 of main body 100. An external force acting in first direction 115 is applied to handle 107 of the latch causing the latch to slide in first direction 115 into the open position and spring 113 to further compress. In this case, the latch is not impeded from sliding into the open position by stopper 109 as it is no longer in line with limit bar 110. When the external force acting in first direction 115 and applied to handle 107 is removed, spring 113 slides the latch back to the closed position in second direction 119 from the open position as it decompresses.

Figure 6:
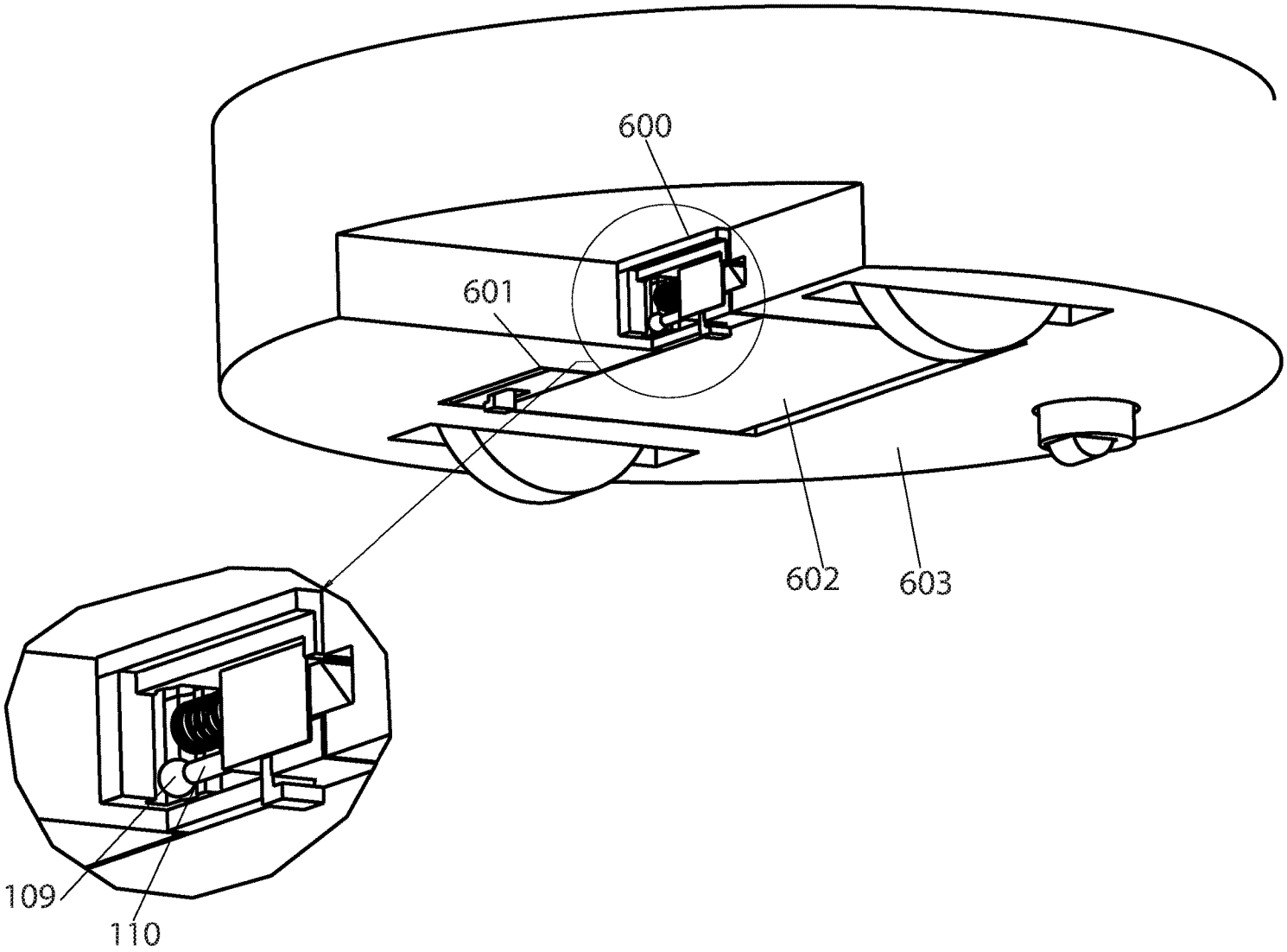
FIG. 6 illustrates two latch mechanisms of a robotic device with a latch of each latch mechanism in a closed position according to some embodiments.

FIG. 6 illustrates two latch mechanisms 600 and 601 fixed to hinged door 602 of robotic device 603. Hinged door 602 is opened by moving the latch into the open position as described above when access to internal components is required. The latch mechanisms 600 and 601 are fixed in an orientation such that stopper 109 of each latch mechanism is positioned in line with limit bar 110 when robotic device 603 is oriented at least partially upright (shown in this figure) to avoid accidentally moving the latch into the open position when access to internal components is not required or while the device is operational.

Figure 7:
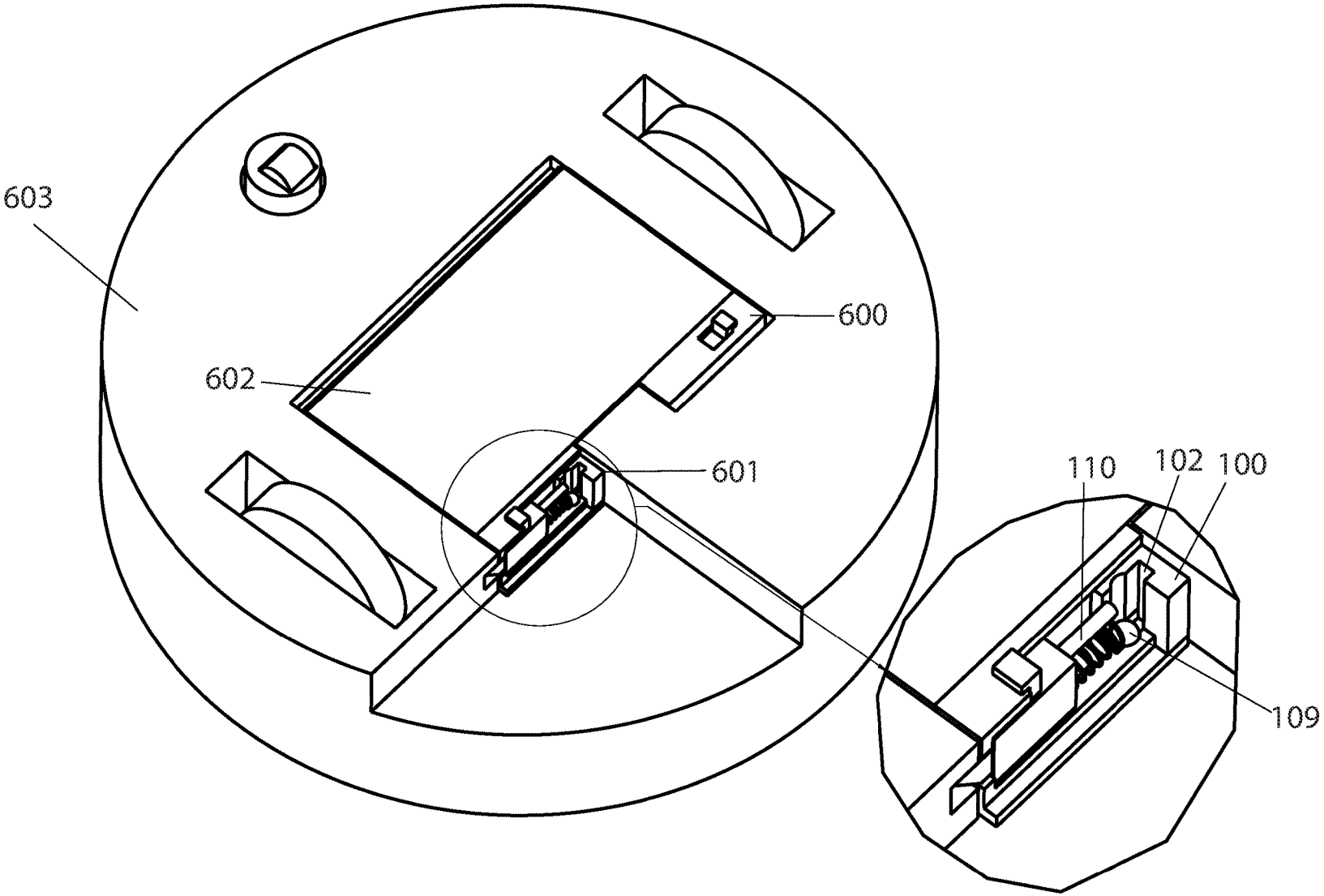
FIG. 7 illustrates two latch mechanisms of a robotic device with a latch of each latch mechanism in a closed position according to some embodiments.

FIG. 7 illustrates robotic device 603 oriented upside down. The latch mechanisms 600 and 601 are fixed to hinged door 602 in an orientation such that stopper 109 of each latch mechanism is not in line with and positioned at an opposite end of second enclosure 102 with respect to the position of limit bar 110 when robotic device 603 is oriented at least partially upside down such that the latch can be placed in an open position to access internal components. Stopper 109 of each latch mechanism slides to the opposite end of second enclosure 102 with respect to the position of limit bar 110 when the orientation of robotic device 603 and hence latch mechanisms 600 and 601 changes as robotic device 603 is rotated to be placed upside down from an upright orientation. A force of gravity acts on stopper 109 of each latch mechanism causing it to slide from one end to another of second enclosure 102.

Figure 8:
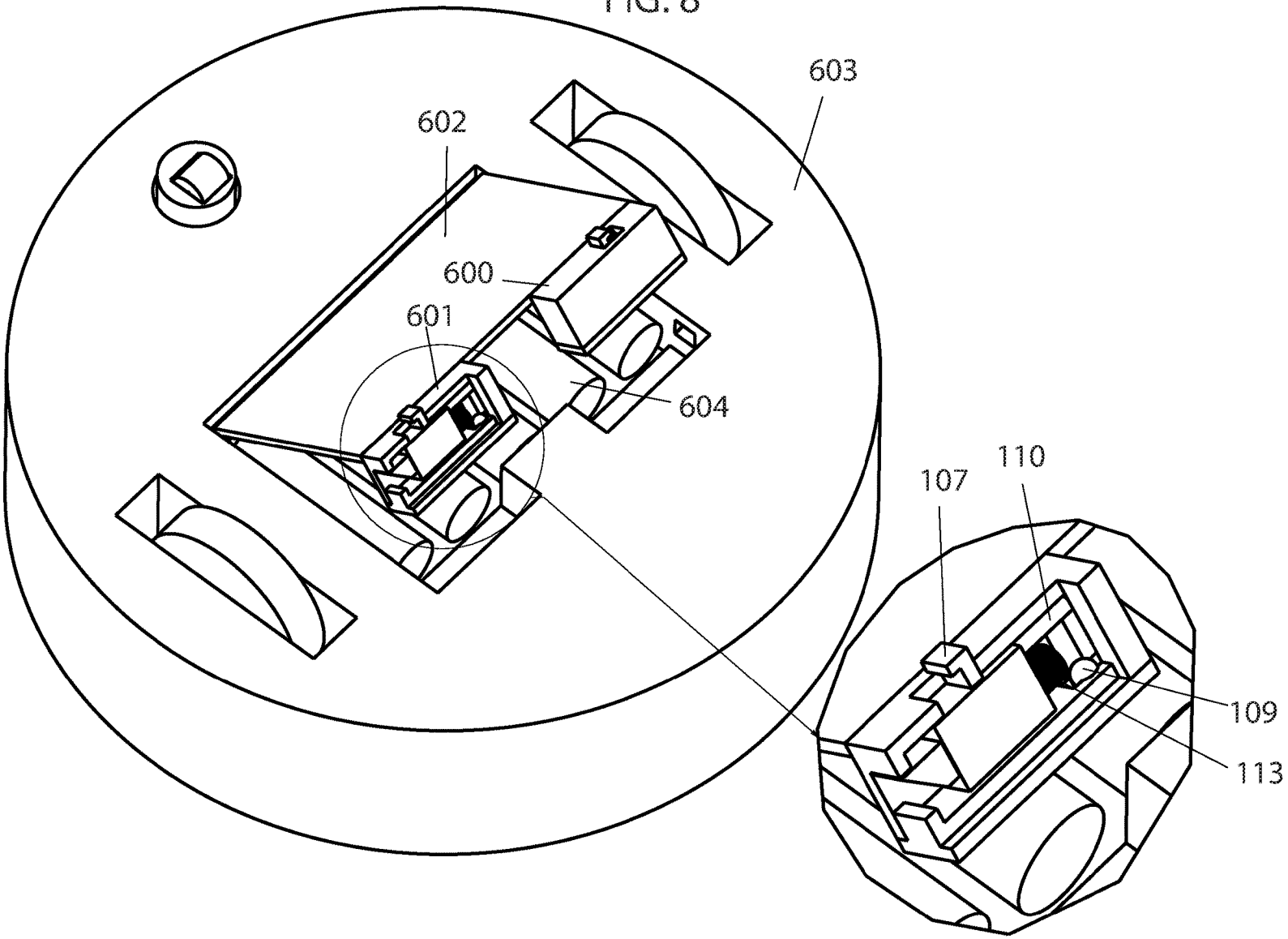
FIG. 8 illustrates two latch mechanisms of a robotic device with a latch of each latch mechanism in an open position according to some embodiments.

FIG. 8 illustrates the latch in the open position for latch mechanisms 600 and 601 fixed to hinged door 602 of robotic device 603 and subsequently hinged door 602 opened to access internal components 604. An external force is applied to handle 107 of each latch causing each latch to slide into the open position and respective springs 113 of each latch mechanism to further compress. Each latch is not impeded from sliding into the open position by respective stoppers 109 of each latch mechanism as stoppers 109 are not in line with respective limit bars 110 of each latch mechanism. When the external force applied to each handle 107 is removed, respective springs 113 of each latch mechanism slide respective latches back to the closed position from the open position as the respective springs 113 decompress.

In block diagrams provided herein, illustrated components are depicted as discrete functional blocks, but embodiments are not limited to systems in which the functionality described herein is organized as illustrated. The functionality provided by each of the components may be provided by software or hardware modules that are differently organized than is presently depicted. For example, such software or hardware may be intermingled, conjoined, replicated, broken up, distributed (e.g. within a data center or geographically), or otherwise differently organized. The functionality described herein may be provided by one or more processors of one or more computers executing code stored on a tangible, non-transitory, machine readable medium. In some cases, notwithstanding use of the singular term "medium," the instructions may be distributed on different storage devices associated with different computing devices, for instance, with each computing device having a different subset of the instructions, an implementation consistent with usage of the singular term "medium" herein. In some cases, third party content delivery networks may host some or all of the information conveyed over networks, in which case, to the extent information (e.g., content) is said to be supplied or otherwise provided, the information may be provided by sending instructions to retrieve that information from a content delivery network.

The reader should appreciate that the present application describes several independently useful techniques. Rather than separating those techniques into multiple isolated patent applications, the applicant has grouped these techniques into a single document because their related subject matter lends itself to economies in the application process. But the distinct advantages and aspects of such techniques should not be conflated. In some cases, embodiments address all of the deficiencies noted herein, but it should be understood that the techniques are independently useful, and some embodiments address only a subset of such problems or offer other, unmentioned benefits that will be apparent to those of skill in the art reviewing the present disclosure. Due to costs constraints, some techniques disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such techniques or all aspects of such techniques.

It should be understood that the description and the drawings are not intended to limit the present techniques to the particular form disclosed, but to the contrary, the intention is to cover all modifications, equivalents, and alternatives falling within the spirit and scope of the present techniques as defined by the appended claims. Further modifications and alternative embodiments of various aspects of the techniques will be apparent to those skilled in the art in view of this description. Accordingly, this description and the drawings are to be construed as illustrative only and are for the purpose of teaching those skilled in the art the general manner of carrying out the present techniques. It is to be understood that the forms of the present techniques shown and described herein are to be taken as examples of embodiments. Elements and materials may be substituted for those illustrated and described herein, parts and processes may be reversed or omitted, and certain features of the present techniques may be utilized independently, all as would be apparent to one skilled in the art after having the benefit of this description of the present techniques. Changes may be made in the elements described herein without departing from the spirit and scope of the present techniques as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. The terms "first", "second", "third," "given" and so on, if used in the claims, are used to distinguish or otherwise identify, and not to show a sequential or numerical limitation.

The present techniques will be better understood with reference to the following enumerated embodiments:

1. A latch mechanism comprising: a main body comprising a first enclosure and a second enclosure, wherein the first enclosure and second enclosure are separated by a separating wall including a slot along the length of the separating wall; a latch comprising: a latch body positioned within and slidingly coupled with the first enclosure of the main body; a latch lock fixed to the latch body and positioned within the first enclosure of the main body when the latch is in an open position and at least partially external to the main body through a first opening of the main body when the latch is in a closed position; and a handle fixed to the latch body and at least partially external to the main body through a second opening of the main body; and a latch locking mechanism comprising: a stopper positioned within and slidingly coupled with the second enclosure of the main body; a limit bar fixed to a face of the latch body facing towards the separating wall and capable of fitting through the slot in the separating wall; a spring holder fixed to the face of the latch body facing towards the separating wall and incapable of fitting through the slot in the separating wall; and a spring positioned on the spring holder and contacting the face of the latch body facing towards the separating wall on a first end of the spring and contacting the separating wall on a second end of the spring, wherein the spring is incapable of fitting through the slot in the separating wall.
2. The latch mechanism of embodiment 1, wherein the latch is in the closed position when the handle contacts a first internal face of the second opening of the main body.
3. The latch mechanism of embodiments 1-2, wherein the latch slides in a first direction towards the separating wall and is in the open position when the latch lock is within the main body.

4. The latch mechanism of embodiments 1-3, wherein the latch slides in the first direction and is in the open position when the limit bar contacts an internal face of the second enclosure of the main body.
5. The latch mechanism of embodiments 1-4, wherein the latch slides in the first direction and is in the open position when the handle contacts a second internal face of the second opening of the main body.
6. The latch mechanism of embodiments 1-5, wherein an external force acting in the first direction and applied to the handle of the latch causes the latch to slide in the first direction.
7. The latch mechanism of embodiments 1-6, wherein the stopper is positioned at a first end of the second enclosure of the main body and in line with the limit bar when the latch is in the closed position.
8. The latch mechanism of embodiment 7, wherein the limit bar contacts the stopper when the latch translates a minimal distance in the first direction to prevent the latch from sliding into the open position.
9. The latch mechanism of embodiment 8, wherein the minimal distance is between 10 to 20 percent of a total distance the latch slides from the closed position to a position where the latch lock is within the main body.
10. The latch mechanism of embodiment 8, wherein the minimal distance is less than the total distance the latch slides from the closed position to the position where the latch lock is within the main body.
11. The latch mechanism of embodiments 1-10, wherein the spring is compressed when the latch is in the closed position and applies a force in a second direction opposite the first direction to maintain the latch in the closed position.
12. The latch mechanism of embodiments 1-11, wherein the stopper is positioned at a second end of the second enclosure of the main body when the latch is in the open position.
13. The latch mechanism of embodiment 12, wherein the stopper slides from the first end of the second enclosure of the main body to the second end of the second enclosure of the main body when the orientation of the latch mechanism changes.
14. The latch mechanism of embodiment 13, wherein a force of gravity acts on the stopper causing it to slide from the first end of the second enclosure of the main body to the second end of the second enclosure of the main body.
15. The latch mechanism of embodiments 1-14, wherein the spring slides the latch to the closed position from the open position when the external force acting in the first direction and applied to the handle is removed.
16. The latch mechanism of embodiments 1-15, wherein the central axes of the first enclosure of the main body and the second enclosure of the main body are perpendicular.
17. The latch mechanism of embodiments 1-16, wherein the latch mechanism is fixed to an item or a component of the item to lock the component in place.
18. The latch mechanism of embodiment 17, wherein the latch mechanism is oriented such that the stopper is positioned at the first end of the second enclosure of the main body when the item is oriented at least partially upright and at the second end of the second enclosure of the main body when the item is oriented at least partially upside down.
19. The latch mechanism of embodiment 17, wherein the item is a robotic device.
20. The latch mechanism of embodiment 17, wherein the component is a hinged door.

I claim:

1. A latch mechanism comprising:

a main body comprising a first enclosure and a second enclosure, wherein the first enclosure and second enclosure are separated by a separating wall including a slot along the length of the separating wall;

a latch comprising:

a latch body positioned within and slidingly coupled with the first enclosure of the main body;

a latch lock fixed to the latch body and positioned within the first enclosure of the main body when the latch is in an open position and at least partially external to the main body through a first opening of the main body when the latch is in a closed position; and a handle fixed to the latch body and at least partially external to the main body through a second opening of the main body; and a latch locking mechanism comprising:

a stopper positioned within and slidingly coupled with the second enclosure of the main body;

a limit bar fixed to a face of the latch body facing towards the separating wall and capable of fitting through the slot in the separating wall;

a spring holder fixed to the face of the latch body facing towards the separating wall and incapable of fitting through the slot in the separating wall; and a spring positioned on the spring holder and contacting the face of the latch body facing towards the separating wall on a first end of the spring and contacting the separating wall on a second end of the spring, wherein the spring is incapable of fitting through the slot in the separating wall.

2. The latch mechanism of claim 1, wherein the latch is in the closed position when the handle contacts a first internal face of the second opening of the main body.

3. The latch mechanism of claim 1, wherein the latch slides in a first direction towards the separating wall and is in the open position when the latch lock is within the main body.

4. The latch mechanism of claim 1, wherein the latch slides in the first direction and is in the open position when the limit bar contacts an internal face of the second enclosure of the main body.

5. The latch mechanism of claim 1, wherein the latch slides in the first direction and is in the open position when the handle contacts a second internal face of the second opening of the main body.

6. The latch mechanism of claim 1, wherein an external force acting in the first direction and applied to the handle of the latch causes the latch to slide in the first direction.

7. The latch mechanism of claim 1, wherein the stopper is positioned at a first end of the second enclosure of the main body and in line with the limit bar when the latch is in the closed position.

8. The latch mechanism of claim 7, wherein the limit bar contacts the stopper when the latch translates a minimal distance in the first direction to prevent the latch from sliding into the open position.

9. The latch mechanism of claim 8, wherein the minimal distance is between 10 to 20 percent of a total distance the latch slides from the closed position to a position where the latch lock is within the main body.

10. The latch mechanism of claim 8, wherein the minimal distance is less than the total distance the latch slides from the closed position to the position where the latch lock is within the main body.

11. The latch mechanism of claim 1, wherein the spring is compressed when the latch is in the closed position and applies a force in a second direction opposite the first direction to maintain the latch in the closed position.

12. The latch mechanism of claim 1, wherein the stopper is positioned at a second end of the second enclosure of the main body when the latch is in the open position.

13. The latch mechanism of claim 12, wherein the stopper slides from the first end of the second enclosure of the main body to the second end of the second enclosure of the main body when the orientation of the latch mechanism changes.

14. The latch mechanism of claim 13, wherein a force of gravity acts on the stopper causing it to slide from the first end of the second enclosure of the main body to the second end of the second enclosure of the main body.

15. The latch mechanism of claim 1, wherein the spring slides the latch to the closed position from the open position when the external force acting in the first direction and applied to the handle is removed.

16. The latch mechanism of claim 1, wherein the central axes of the first enclosure of the main body and the second enclosure of the main body are perpendicular.

17. The latch mechanism of claim 1, wherein the latch mechanism is fixed to an item or a component of the item to lock the component in place.

18. The latch mechanism of claim 17, wherein the latch mechanism is oriented such that the stopper is positioned at the first end of the second enclosure of the main body when the item is oriented at least partially upright and at the second end of the second enclosure of the main body when the item is oriented at least partially upside down.

19. The latch mechanism of claim 17, wherein the item is a robotic device.

20. The latch mechanism of claim 17, wherein the component is a hinged door.

* * * * *